US007196664B2

(12) United States Patent
Asai

(10) Patent No.: US 7,196,664 B2
(45) Date of Patent: Mar. 27, 2007

(54) DIELECTRIC ANTENNA AND COMMUNICATION DEVICE INCORPORATING THE SAME

(75) Inventor: Hidekatsu Asai, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/001,318

(22) Filed: Dec. 2, 2004

(65) Prior Publication Data

US 2005/0134510 A1 Jun. 23, 2005

(30) Foreign Application Priority Data

Dec. 4, 2003 (JP) ..... P2003-405515

(51) Int. Cl.
*H01Q 1/24* (2006.01)
*H01Q 1/38* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS

2001/0015701 A1 8/2001 Ito et al.
2001/0048390 A1* 12/2001 Nagumo et al. ..... 343/700 MS
2002/0089454 A1 7/2002 Eggleston et al. ..... 343/702

FOREIGN PATENT DOCUMENTS

| | | |
|---|---|---|
| EP | 1 122 812 A2 | 8/2001 |
| JP | A-10-13135 | 1/1998 |
| JP | A-2001-7639 | 1/2001 |
| JP | 2002-118418 | 4/2002 |
| JP | 2002-158529 | 5/2002 |
| WO | WO 2004/047220 A1 | 11/2002 |

* cited by examiner

*Primary Examiner*—Michael C. Wimer
(74) *Attorney, Agent, or Firm*—Morgan, Lewis & Bockius LLP

(57) ABSTRACT

A dielectric substrate has a first face, a second face opposing to the first face, and side faces connecting the first face and the second face. A grounding electrode is provided on the first face. A first radiation electrode is configured to resonate with an electromagnetic wave having a first frequency. The first radiation electrode extends parallel to at least one of the second face and the side faces. A feeder electrode extends parallel to one of the side faces, and is electromagnetically coupled with the first radiation electrode. A second radiation electrode is configured to resonate with an electromagnetic wave having a second frequency. The second radiation electrode extends parallel to one of the side faces and is electromagnetically coupled with at least one of the first radiation electrode and the feeder electrode. One end of the feeder electrode serves as a terminal for supplying power to the first radiation electrode and the second radiation electrode.

9 Claims, 8 Drawing Sheets

DIELECTRIC ANTENNA AND COMMUNICATION DEVICE INCORPORATING THE SAME

BACKGROUND OF THE INVENTION

The present invention relates to a dielectric antenna adapted to communicate signals in dual band with one antenna and to a communication device incorporating such an antenna. More particularly, the present invention relates to a dielectric antenna which is loaded on personal computers, cellular phones, portable remote terminals and so forth, suitable for use in LANs (Local Area Networks).

Utilization of wireless LAN becomes popular in recent years, the wireless LAN using radio waves for exchanging data between units of electronic equipment; for example, among personal computers and between a personal computer and a cellular phone. For the wireless LAN, there have heretofore been used a frequency band of 2.4 GHz only and a dielectric antenna as an antenna generally employing a dielectric substrate and a radiation electrode formed with a conductive film for downsizing purposes.

With the recent development of information technology, the data exchanged over the wireless LAN has come to include data such as images having a large quantity of information. Consequently, it is proposed to use different frequency bands; namely, a frequency band of 5.2 GHz so that data having a large quantity of information is communicated at a high transmission rate and a frequency band of 2.4 GHz offering a long communication distance so that ordinary data is communicated out of the information communicated over the wireless LAN. Therefore, with respect to the antenna for the wireless LAN loaded on electrical equipment having the radio communication functions of the sort mentioned above, it is also conceivable to juxtapose a first antenna for the 2.4 GHz band (size: 15 mm (length)×7 mm (width)×6 mm (height)) and a second antenna for the 5.2 GHz band (size: 10 mm (length)×4 mm (width)×3 mm (height)).

On the other hands, there is a known method of making one antenna trigger resonances in two desired frequency bands by using a folded element (in a meandering form) to form a radiation electrode with a conductive film so as to adjust the number of meanderings as well as the element-to-element distance (cf., Japanese Patent Publication No. 10-13135A, for example).

Further, as shown in FIG. 12, there is a known antenna of a one-chip type corresponding to dual band and having a feeder-side radiation electrode 53 and a non-feeder-side radiation electrode 54 that are formed side by side on the top face of a rectangular dielectric substrate 51 such that excitation directions A and B cross at right angles (cf., Japanese Patent Publication No. 2001-7639A, for example).

With the above configuration that two antennas are juxtaposed, two antennas have to be produced for each set of electrical equipment and this results in an increase in the cost. Since the two antennas have to be juxtaposed, they take up a lot of space and this is contrary to the demands of the present age for the downsizing of electronic equipment.

On the other hand, in order to make one radiation electrode trigger resonances in dual band such that one is about twice as long as the other, a meticulous adjustment becomes required and this also results in an increase in the cost because the adjustment of resonance frequency on one side to deal with anomalies in products affects the resonance frequency and matching characteristic in the other frequency band, so that an increase in the cost occurs as the adjusting man-hour increases.

In such a type that two radiation electrodes are formed on the same face of a dielectric substrate, the surface area of an antenna tends to become large because two of the radiation electrodes are disposed in parallel on the face side of the dielectric substrate and this results in failing to meet the demands for downsizing. Even though these radiation electrodes are arranged so that the excitation directions cross at right angles, the problem in this case is that the electrodes will interfere with each other when the space therebetween is narrow and the adjustment of the resonance frequency on one side affects the matching characteristic and resonance frequency in the other frequency band, thus making the adjustment difficult. Although the space between the radiation electrodes has to be increased to avoid the above isolation problem as much as possible, another problem arising from increasing the space between the two radiation electrodes is that the surface area of the antenna becomes still larger.

SUMMARY OF THE INVENTION

It is therefore an object of the invention to provide a dielectric antenna capable of communicating in dual band with one element, without increasing not only the surface area of the antenna but mutual interference between the dual band.

It is also an object of the invention to provide a communication device incorporating such a dielectric antenna.

In order to achieve the above objects, according to the invention, there is provided a dielectric antenna, comprising:

a dielectric substrate, having a first face, a second face opposing to the first face, and side faces connecting the first face and the second face;

a grounding electrode provided on the first face;

a first radiation electrode, configured to resonate with an electromagnetic wave having a first frequency, the first radiation electrode being extended parallel to at least one of the second face and the side faces;

a feeder electrode, extended parallel to one of the side faces, and electromagnetically coupled with the first radiation electrode; and a second radiation electrode, configured to resonate with an electromagnetic wave having a second frequency, the second radiation electrode being extended parallel to one of the side faces and electromagnetically coupled with at least one of the first radiation electrode and the feeder electrode, wherein one end of the feeder electrode serves as a terminal for supplying power to the first radiation electrode and the second radiation electrode.

Here, the "electromagnetic coupling" includes at least one of coupling by direct joint, capacity coupling and magnetic coupling.

With the above configuration, the first radiation electrode and the second radiation electrode can be arranged on a small body of the dielectric substrate while maintaining a relatively large distance between both radiation electrodes. Since the interference between the radiation electrodes can be made small, it is possible to suppress the affection to the resonance frequencies and the matching characteristics due to the interference.

On the other hand, power feeding ends of the radiation electrodes can be approached because such approach will not affect the coupling therebetween so much. Accordingly, both radiation electrodes can be connected to the same feeder electrode. Even if the second radiation electrode is directly connected to the feeder electrode, by narrowing the distance between the power feeding ends, the second radiation electrode can be electrically coupled with the feeder electrode by way of the first radiation electrode. As a result, signals associated with two frequencies can be communicated via the single power feeder while maintaining the independent adjustability for the resonance frequencies and the matching characteristics of the radiation electrodes.

As a result, it is possible to attain a downsized antenna having enhanced isolation between two frequencies. It is advantageous in use for communicating normal data and large data such as images by way of two suitable frequencies using the wireless LAN.

Preferably, the first radiation electrode extends parallel to at least one of the second face and a first one of the side faces. The first radiation electrode has a first end which is made open and a second end which is connected to the ground electrode. The feeder electrode extends parallel to one of the first one of the side faces and a second one of the side faces. The second radiation electrode extends parallel to one of the second one of the side faces.

Here, it is preferable that the first radiation electrode includes a first section extending parallel to the second face, and a second section extending parallel to at least one of the side faces so as to connect the first section and the grounding electrode. In this case, the resonance frequency and the matching characteristics of the first radiation electrode can be adjusted by changing the width of the second section.

It is also preferable that: the second radiation electrode has a first end which is made open and a second end which is connected to the ground electrode; and the second radiation electrode extends so as to have at least one curved portion. In this case, by narrowing a width of the curved portion, the resonance frequency of the second radiation electrode can be adjusted.

It is further preferable that the second radiation electrode extends in a meandering manner. In this case, the space dominated by the second radiation electrode can be reduced while maintaining the resonance frequency thereof. In addition, the area that the first radiation electrode and the second radiation electrode are closely opposed can be reduced. Accordingly, the independent adjustment of the characteristics of the first radiation electrode and the second radiation electrode can be facilitated since the coupling between both of the radiation electrodes becomes weak.

Preferably, the first radiation electrode is provided on a first one of the side faces, and the second radiation electrode is provided on a second one of the side faces which opposes to the first one of the side faces. In this case, the distance between the first radiation electrode and the second radiation electrode is further enlarged, so that the coupling between both of the radiation electrodes becomes weak. Accordingly, the independent adjustment of the characteristics of the first radiation electrode and the second radiation electrode can be facilitated.

Preferably, the first radiation electrode and the feeder electrode are directly connected.

Preferably, the terminal is provided on the first face while being insulated from the grounding electrode. In this case, a power feeding section on a circuit board and the terminal can be easily connected by simply mounting the antenna on the circuit board.

According to the invention, there is also provided a communication device, comprising:

a communication circuit, adapted to execute data communication with an external communication device; and the above dielectric antenna, electrically connected to the communication circuit.

With this configuration, the data communication described the above can be executed without requiring a space and without changing the arrangement of the conventional circuit board installed in the communication device.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1A:
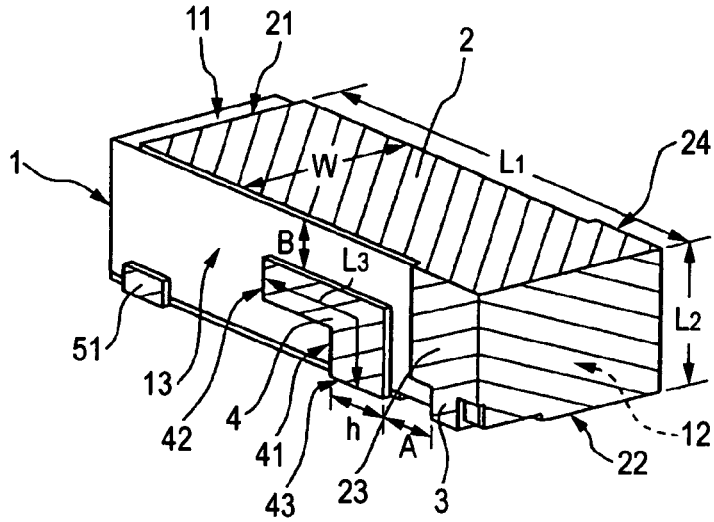
FIG. 1A is a perspective top view of a dielectric antenna according to a first embodiment of the invention.
Figure 1B:
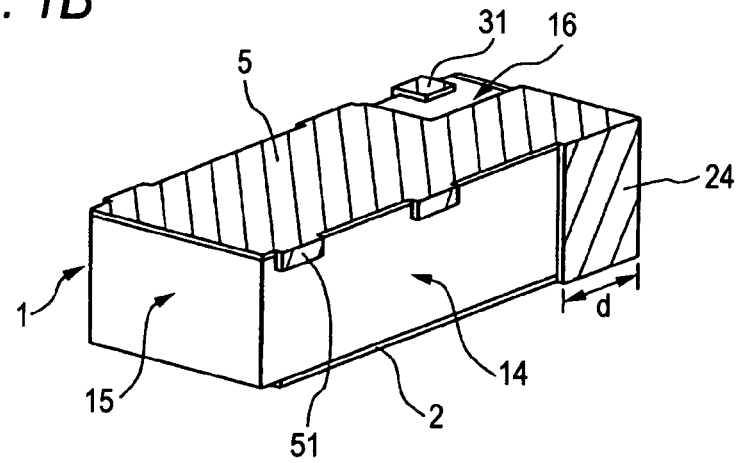
FIG. 1B is a perspective bottom view of the dielectric antenna of FIG. 1A.

Embodiments of the invention will be described below in detail with reference to the accompanying drawings. FIGS. 1A and 1B show a dielectric antenna according to a first embodiment of the invention.

In this embodiment, a first radiation electrode 2 for use mainly in a first frequency band $f_1$ is provided as a conductive film formed on a dielectric substrate 1. One end 21 of the first radiation electrode 2 is provided as an open end on a top face 11 of the dielectric substrate 1. The first radiation electrode 2 is extended by way of the top face 11 and a side face 12 and connected to a grounding electrode 5 formed on a bottom face 16 opposing to the top face 11. The longitudinal dimension ($L_1$+$L_2$) from the one end 21 to the other end 22 of the radiation electrode 2 is set equal to an electrical length of approximately ¼ of the wavelength of the desired first frequency band ($\lambda_1$). Since this physical length is inversely proportional to the square root of the relative dielectric constant $\epsilon_r$ of the dielectric substrate 1 (proportional to $\epsilon_r^{-1/2}$), the physical length can be shortened as described above by using a dielectric substrate 1 having a greater dielectric constant.

Specifically, the dielectric substrate 1 is desirably made of ordinary ceramics having a relative dielectric constant of about 8, for example, may be used though ceramics such as $BaO—TiO_2—SnO_2$, $MgO—CaO—TiO_2$ or the like is preferred in point of downsizing as the relative dielectric constant becomes about 20 or greater. Further, the dielectric substrate 1 may be formed integrally of dielectric material such as ceramics, formed by laminating and sintering thin ceramic sheets provided with proper conductive films thereon or formed by laminating glass epoxy films provided with proper conductive films.

In this embodiment, the width W of the first radiation electrode 2 is set substantially equal to the width of the dielectric substrate 1. The greater the width W of the radiation electrode 1, the wider the band characteristics become, which is desirable.

In this embodiment, not only the first radiation electrode 2 is formed over a first side face 12 from the top face 11 but also side radiation electrodes 23 and 24 are formed on the second side face 13 and the third side face 14 that are adjacent to the first side face 12. Further, the side radiation electrode 23 formed on the second side face 13 is connected to a feeder electrode 3 (described later), while the side radiation electrode 24 formed on the third side face 14 is directly connected to the grounding electrode 5. The resonance frequencies of side radiation electrodes 23 and 24 formed on the respective second and third side faces 13 and 14 are lowered by narrowing their width "d" and when their resonance frequencies change under the influence of the second radiation electrode 4, which will be described later, the side radiation electrodes 23 and 24 are subjected to adjustment by changing the width of the side radiation electrodes 23 and 24. The radiation electrode 2 is not limited in configuration to the example shown above but may be provided on any one of the side faces other than the top face unless close coupling is established between the radiation electrode 2 and the second radiation electrode 4.

In this embodiment, the feeder electrode 3 is directly connected to the first radiation electrode 2. Although the boundary between the feeder electrode 3 and the radiation electrode 2 is not clearly defined in such a structure, the wider portion is defined as a part of the first radiation electrode 2 (the side radiation electrode 23) and the narrower portion is defined as the feeder electrode 3 herein for convenience. However, the width of the feeder electrode 3 may be coincident with that of the side radiation electrode 23, or it may cause the entire part of the electrode formed on the second side face 13 to serve as the feeder electrode 3. The feeder electrode 3 is connected to a portion of the radiation electrode 2, having a predetermined impedance to form an inverted-F antenna.

The end portion of the feeder electrode 3 is made the feeder terminal 31 provided separately from the grounding electrode 5 as shown in FIG. 1B. When the end portion thereof is mounted onto a circuit board (not shown), it is directly connected to the feeder portion of the circuit board by soldering. The feeder electrode 3 is provided in various places as will be described later.

A second radiation electrode 4 is a radiation electrode for use mainly in the second frequency band $f_2$ and is formed on the second side face 13 of the dielectric substrate 1, so that it is electromagnetically coupled with the feeder electrode 3 and/or the first radiation electrode 2 and resonated in the second frequency band. In this embodiment, the second radiation electrode 4 is formed closer to the feeder electrode 3 so that it is coupled with the feeder electrode 3 more strongly; in other words, the second radiation electrode 4 is formed so that it is weakly coupled with the main part of the first radiation electrode 2 formed on the top face 11 of the dielectric substrate 1 whereby to increase the distance B between the second radiation electrode 4 and the first radiation electrode 2 as much as possible. With the arrangement above, since the first radiation electrode 2 and the second radiation electrode 4 can be adjusted separately from each other with respect to the resonance frequency and matching characteristic (voltage standing wave ratio; VSWR), the manufacturing of the dielectric antenna can be facilitated.

The second radiation electrode 4 is formed such that it is extended in the longitudinal direction and bent toward the grounding electrode 5 with its length $L_3$ being equal to an electrical length of approximately ¼ of the wavelength of the second frequency band ($\lambda_2$). Even in this case, further, the resonance frequency can be lowered by scraping a bent portion 41 so as to reduce width "h" whereby to increase $L_3$. When the resonance frequency and matching characteristic are caused to change by coupling the second radiation electrode 4 with the first radiation electrode 2, the adjustment can be made by changing the width "h" of the bent portion 41.

In a case where the second radiation electrode 4 becomes long with the frequency of the second frequency band being low, the second radiation electrode 4 may be formed from the second side face 13 to a fourth side face 15 opposing the first side face 12 or may be in a meandering form as will be described later. With the second radiation electrode 4 formed on the third side face 14, the second radiation electrode 4 may be formed so that it is coupled with the feeder electrode 3 via the first radiation electrode 2 without being directly coupled with the feeder electrode 3.

The grounding electrode 5 is provided over the substantially whole bottom face 16 excluding a portion where the feeder terminal 31 is provided. Part of the grounding electrode 5 is partly continued to the second and third side faces 13, 14 as a fixing terminal 51. When the grounding electrode 5 is mounted onto a circuit board (not shown), it is fixed to the earth-line of the circuit board by soldering, whereby the fixation of the antenna and the electrical connection of the grounding electrode 5 can be conducted simultaneously.

Although providing the grounding electrode 5, the first and second radiation electrodes 2 and 4, the feeder electrode 3 and so forth in position on the dielectric substrate 1 by printing conductive films such as silver films or vacuum plating and patterning is preferred because these component parts are formable with ease, the way to form them is not limited to this example but may include a structure in which conductive lines or plates made of copper are provided in prescribed locations on the dielectric substrate 1. Further, it is possible to form the first and second radiation electrodes 2 and 4, the feeder electrode 3 and the grounding electrode 5 or at least part of any one of them inside the dielectric substrate 1 by forming a conductive film pattern in part of the dielectric sheet, laminating and sintering the dielectric sheets.

In the case of an electrode provided on the side or along the side of the dielectric substrate 1 like the second radiation electrode 4 and the feeder electrode 3, a belt-shaped via contact is formed on each of the dielectric sheets and by laminating the sheets whereby to form a conductive film in the vertical direction and the dielectric film is provided on the side after the formation of a laminated dielectric sheet body so as to form an electrode. Moreover, such an electrode can be formed inside by covering the face with the dielectric sheet.

Figure 1C:
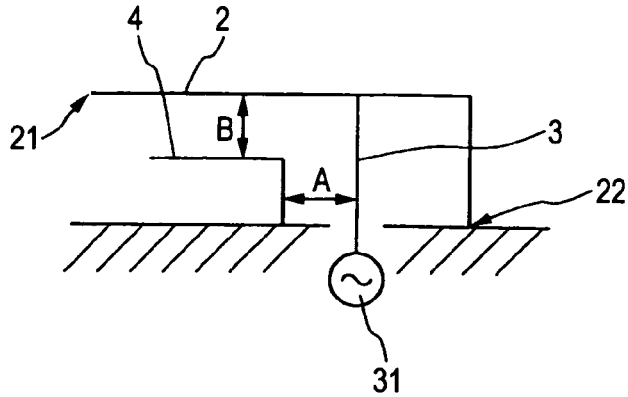
FIG. 1C is a diagram of an equivalent circuit of the dielectric antenna of FIG. 1A.

The first radiation electrode 2 so configured as described the above serves as an inverted-F antenna as shown by an equivalent circuit diagram in FIG. 1C. The second radiation electrode 4 is electromagnetically coupled with the feeder electrode 3, that is, the feeder terminal 31 by. the distance A with respect to the feeder electrode 3 and the distance B with respect to the first radiation electrode 2. The resonance frequencies and matching characteristics of the first and second radiation electrodes 2 and 4 change, depending on the degree of coupling the second radiation electrode 4 with the feeder electrode 3 as well as the first radiation electrode 2 and by setting the distances A and B so that both of them are optimized, the resonance frequencies and matching characteristics in the dual band can be adjusted.

Figure 2:
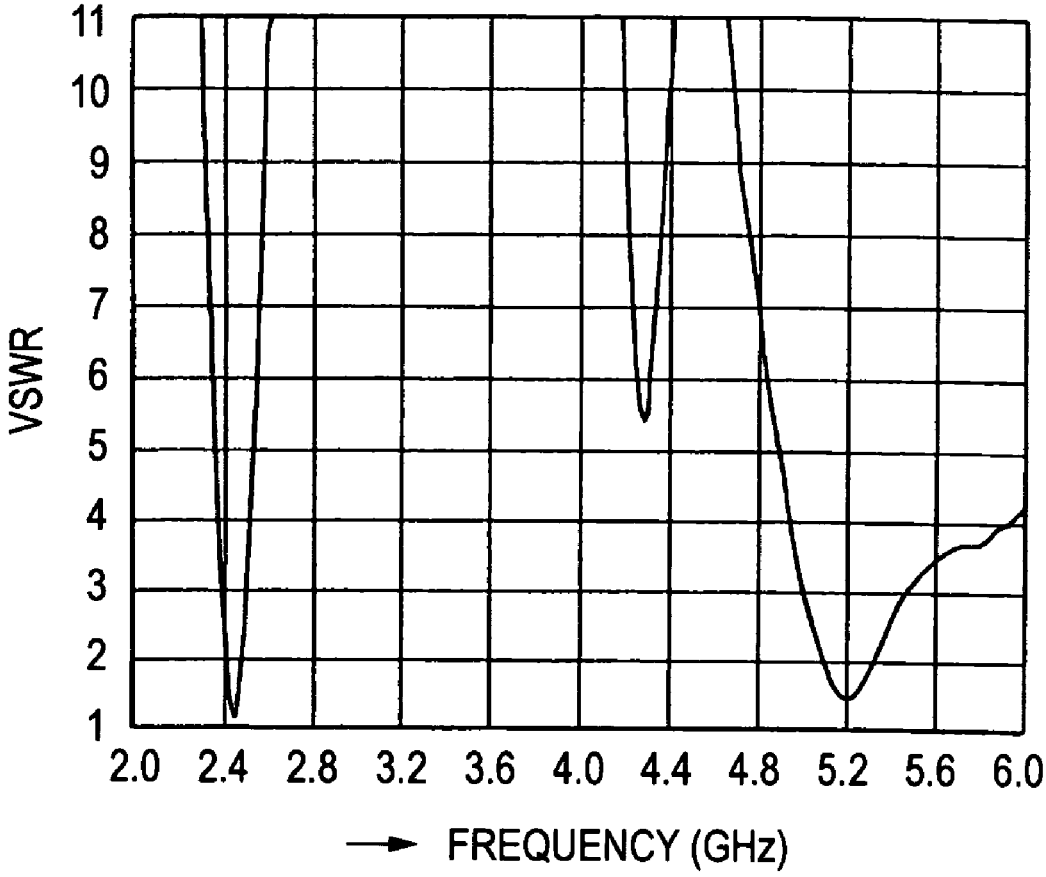
FIG. 2 is a graph of VSWR characteristics in connection with frequency variation.

With the structure above, ceramics (relative dielectric constant $\epsilon_r$=8) formed of $SiO_2$+MgO was used as the dielectric substrate 1 measuring 15 mm (length)×7 mm (width)×6 mm (height or thickness); the first radiation electrode 2 for use at 2.4 GHz as the first frequency band $f_1$ was formed with the same width $L_1$=11.8 mm as the width of the dielectric substrate 1 and with $L_2$=7.8 mm (thickness of the dielectric substrate 1); the second radiation electrode 4 for use at 5.2 GHz as the second frequency band $f_2$ was formed with the width $L_3$=5 mm; and the distances A and B were set at 1.5 mm and 2 mm, respectively. As a result, an antenna having VSWR frequency characteristics as shown in FIG. 2 was obtained, which antenna was low at VSWR in the vicinity of 2.4 GHz and 5.2 GHz. When this antenna was obtained, the distance A was adjusted by scraping the side end portion of the feeder electrode 3 of the second radiation electrode 4 to widen the space, whereas the distance B was adjusted by scraping the upper end portion of the second radiation electrode 4 to widen the space, the aforementioned dimensions being obtained in such a state that the best results were attained.

Figure 3A:
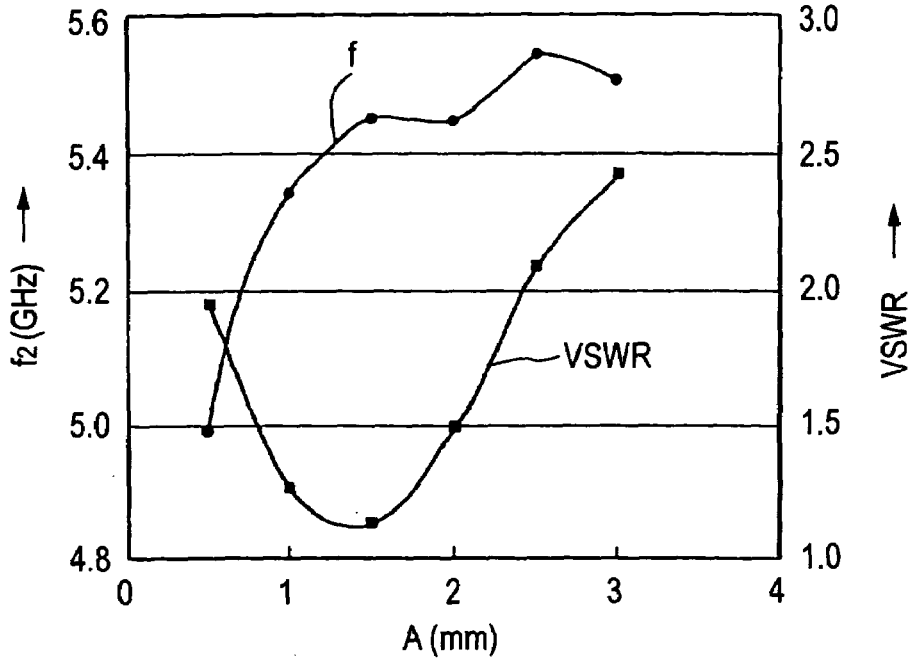
FIGS. 3A and 3B are graphs of resonance frequency characteristics and VSWR characteristics in connection with variation of the distance A in FIG. 1A for each of communication frequencies.
Figure 3B:
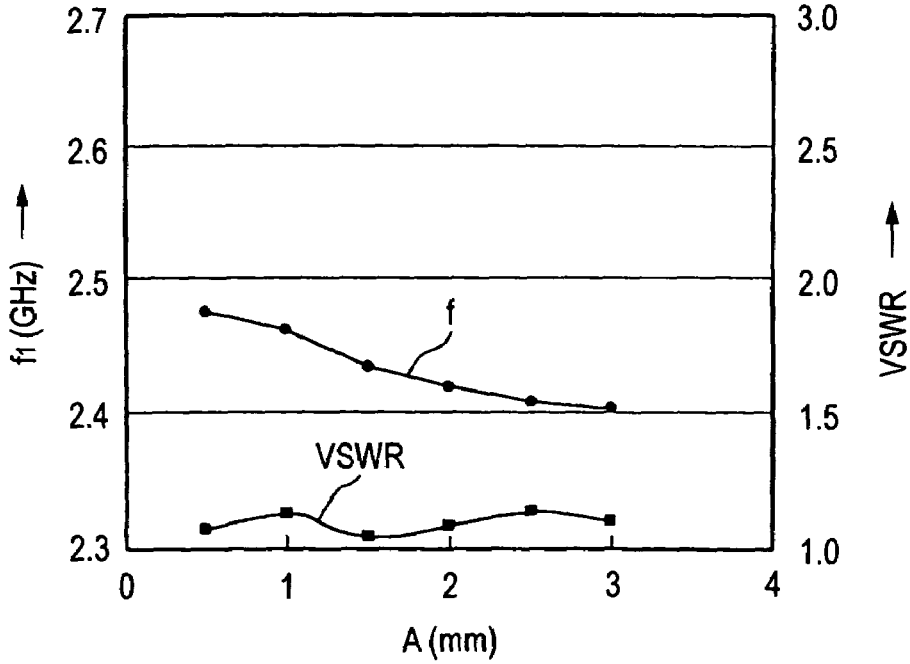

With reference to the dimensional example above, FIGS. 3A and 3B show the results of examining variations in the resonance frequencies and VSWR in the 2.4 GHz and 5.2 GHz bands when the distance A is varied while the distance B is kept at 2 mm. The distance A was varied by scraping the side end portion of the feeder electrode 3 as described above. As shown in these figures, almost no change of VSWR is seen in the 2.4 GHz band and the best result is seen when the distance A is 1.5 mm in the 5.2 GHz band.

Figure 4A:
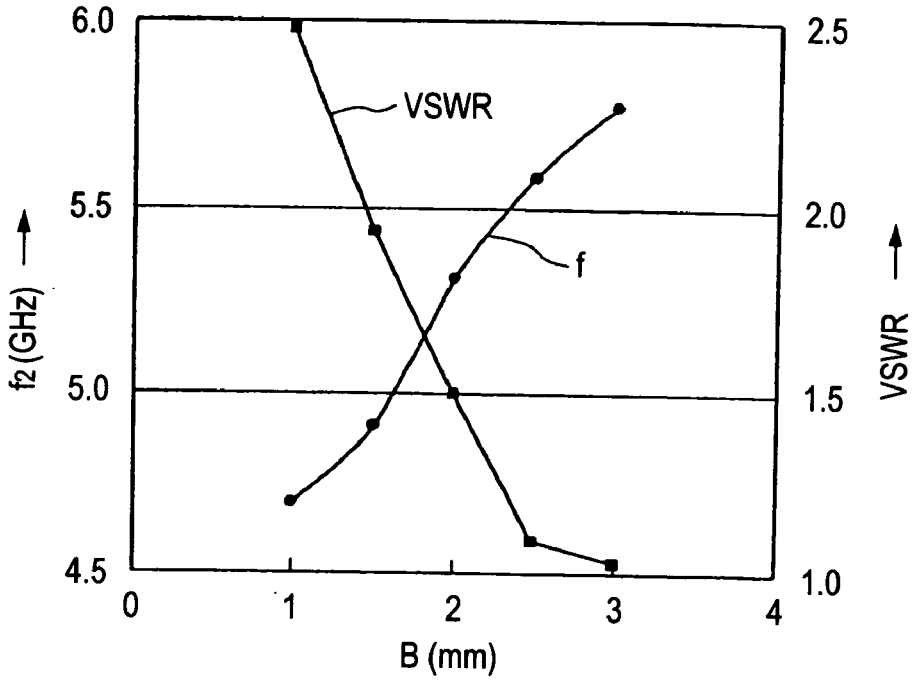
FIGS. 4A and 4B are graphs of resonance frequency characteristics and VSWR characteristics in connection with variation of the distance B in FIG. 1A for each of communication frequencies.
Figure 4B:
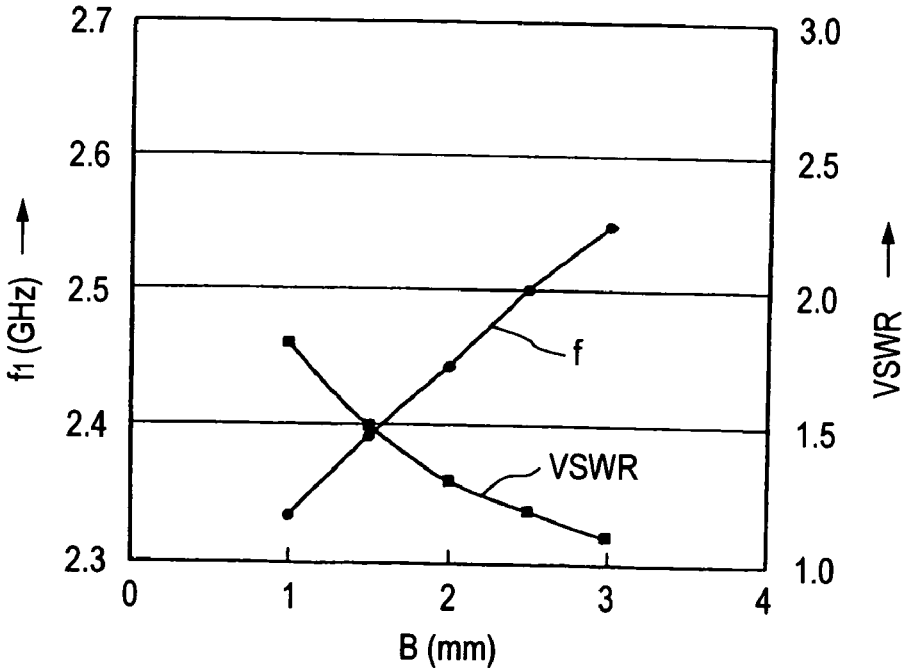

Further, FIGS. 4A and 4B show the results of examining variations in the resonance frequencies and VSWRs in the 2.4 GHz and 5.2 GHz bands when only the distance B is varied while the distance A is kept at 1.5 mm. In this case, the distance B was changed by scraping the upper end portion of the second radiation electrode 4 so as to gradually enlarge the space with the first radiation electrode 2. As shown in these figures, good results are seen to be obtainable in both the 2.4 GHz and 5.2 GHz bands when the distance B is enlarged.

In summarize, the first radiation electrode 2 is formed such that the one end 21 is provided as an open end on the end portion of the top face 11 of the dielectric substrate 1; the other end 22 is extended along the longitudinal direction on the top face 11 of the dielectric substrate 1 and connected to the grounding electrode 5 via the first side face 12; and the feeder electrode 3 is connected to the first radiation electrode 2 in a portion close to the other end 22 having the predetermined impedance to form the inverted-F antenna as shown in the equivalent circuit diagram of FIG. 1C.

Consequently, the resonance can be triggered in the first frequency band $f_1$ of wavelength $\lambda_1$ with an electrical length of $L_1+L_2=\lambda_1/4$. The second radiation electrode 4, on the other hand, is formed on the second side face 13 in an extended condition in the longitudinal direction of the side of the dielectric substrate 1 as well. The one end portion 42 of the second radiation electrode 4 is provided as an open end with the other end portion thereof connected to the grounding electrode 5, and as the second radiation electrode 4 is magnetically coupled with the feeder electrode 3 in the vicinity of the portion connected to the grounding electrode 5, the second radiation electrode 4 similarly operates as the inverted-F antenna, so that the resonance can be triggered in the second frequency band $f_2$ of wavelength $\lambda_2$ with an electrical length of $L_3=\lambda_2/4$.

As described above, on the other hand, the first radiation electrode 2 and the second radiation electrode 4 are coupled with each other to no small extent and mutually affect each other. However, since the first radiation electrode 2 and the second radiation electrode 4 are provided on the faces that cross at right angles, the space between the radiation electrodes thus coupled together grows larger. Consequently, the frequencies and the VSWRs slightly change as shown in FIGS. 3A through 4B, whereupon the resonance frequencies and the VSWRs of both the radiation electrodes 2 and 4 are made adjustable independently from each other by adjusting the width of the side radiation electrode 23 or the side radiation electrode 24 provided on the second side face 13 or the third side face 14 of the first radiation electrode 2 and changing the width of the vertical portion of the second radiation electrode 4.

Then it is possible to communicate signals in dual band of 2.4 GHz and 5.2 GHz, for example, with an antenna using one dielectric substrate having a small surface area and even when the wireless LAN is used to receive data containing data having a large quantity of information such as images, different frequency bands, 5.2 GHz and 2.4 GHz, are utilized for communicating data having a large quantity of information in the former case offering a high transmission rate and for communicating ordinary data in the latter case suitable for a long-distance communication, so that the wireless LAN is effectively utilizable.

Figure 5:
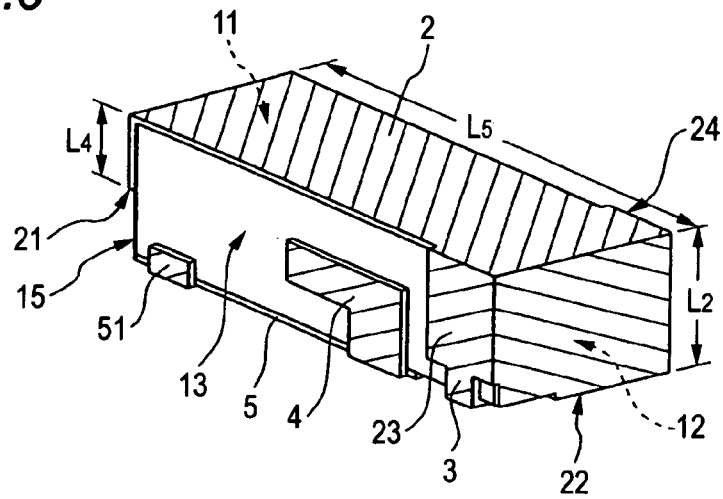
FIG. 5 is a perspective view of a dielectric antenna according to a second embodiment of the invention.

FIG. 5 shows a second embodiment of the invention. Similar components to those in the first embodiment will be designated by the same reference number and the repetitive explanation for those will be omitted.

In this embodiment, the first radiation electrode 2 is extended up to the fourth side face 15 so that the open end 21 is provided on the fourth side face 15. With this structure, the length $L_5$ of the dielectric substrate 1 can be shortened because it is only needed for the sum of the length $L_4$ of the first radiation electrode 2 in the portion of the fourth side face 15, the longitudinal dimension $L_5$ of the dielectric substrate 1 and the length $L_2$ of the first side face 12 ($L_4+L_5+L_2$) to become equivalent to the electrical length of $\lambda_1/4$, so that the downsizing of the antenna is attemptable.

Figure 6A:
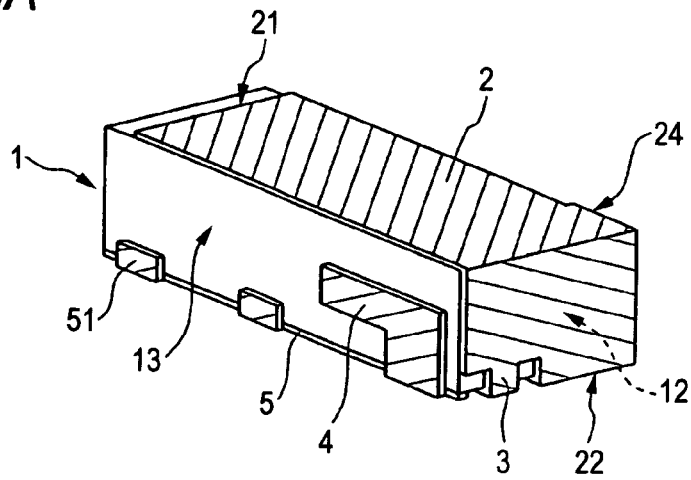
FIG. 6A is a perspective top view of a dielectric antenna according to a third embodiment of the invention.
Figure 6B:
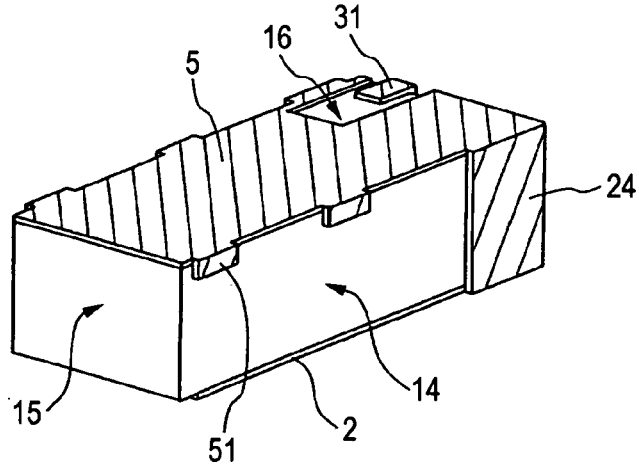
FIG. 6B is a perspective bottom view of the dielectric antenna of FIG. 6A.

FIGS. 6A and 6B show a third embodiment of the invention. Similar components to those in the first embodiment will be designated by the same reference number and the repetitive explanation for those will be omitted.

In this embodiment, the other end 22 of the first radiation electrode 2 is connected to the grounding electrode 5 via the first side face 12 and part of the radiation electrode 2 on the first side face 12 is not connected to the grounding electrode 5 but connected to the feeder electrode 3. More specifically, a part of the radiation electrode 2 closer the second side face 13 is not connected to the grounding electrode 5 but connected to the feeder electrode 3 formed on the first side face 12 and the rest part of the radiation electrode 2 is connected to the grounding electrode 5. Consequently, the structure of the combination of the radiation electrode 2 and the coupling electrode 3 is similar to the aforementioned structure. Even this structure is made to operate as the inverted-F antenna as in the aforementioned embodiments by setting the distance between the joint of the radiation electrode 2 toward the grounding electrode 5 and the feeder electrode 3 so that the node between the feeder electrode 3 and the radiation electrode 2 is located at a position having the predetermined impedance.

Although the feeder electrode 3 and the second radiation electrode 4 are not formed on the same face, the feeder electrode 3 and the second radiation electrode 4 are strongly coupled together by the magnetic field, so that both of them can substantially be coupled as well if the distance therebetween is close. Incidentally, the feeder terminal 31 is formed on the bottom face 16 at a position closer to the first side face 12 and surrounded with the grounding electrode 5. This structure is allowed to deal with a case where power cannot be supplied from the side of the second side face 13 or the third side face 14.

Figure 7:
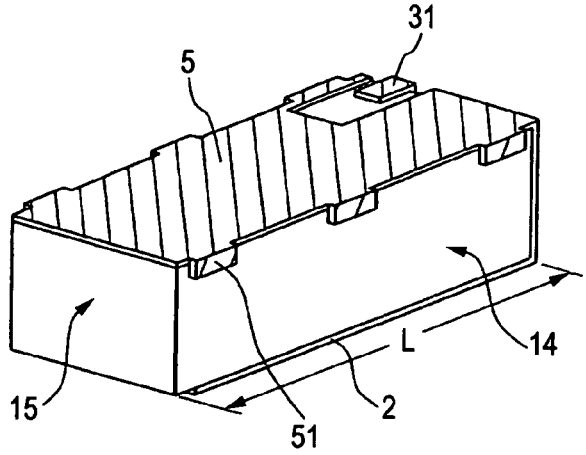
FIG. 7 is a perspective view of a dielectric antenna according to a fourth embodiment of the invention.

FIG. 7 shows a fourth embodiment of the invention. Similar components to those in the first embodiment will be designated by the same reference number and the repetitive explanation for those will be omitted.

In this embodiment, the side radiation electrode 24 is removed from the structure of the third embodiment. As described above, even though the resonance frequency and the VSWR are changed by the coupling between the first radiation electrode and the second radiation electrode, such changes can be adjusted by providing the side radiation electrode 24 and changing the width thereof. With the design adjusted once, the same frequency and VSWR characteristics are obtainable from the same structure manufactured and when the adjustment of impedance changing due to a circuit board is completed, that circuit board can be formed in a prescribed configuration. Therefore, the side radiation electrode becomes unnecessary on condition that the adjustment above can be conducted without the side radiation electrode.

With the structure above, as the length of the portion of the radiation electrode can be increased, the portion thereof being not connected to the grounding electrode 5, the length L in the longitudinal direction of the dielectric substrate 1 can be decreased, so that the downsizing of the antenna is attemptable. This configuration is applicable to all the embodiments as described the above.

Figure 8:
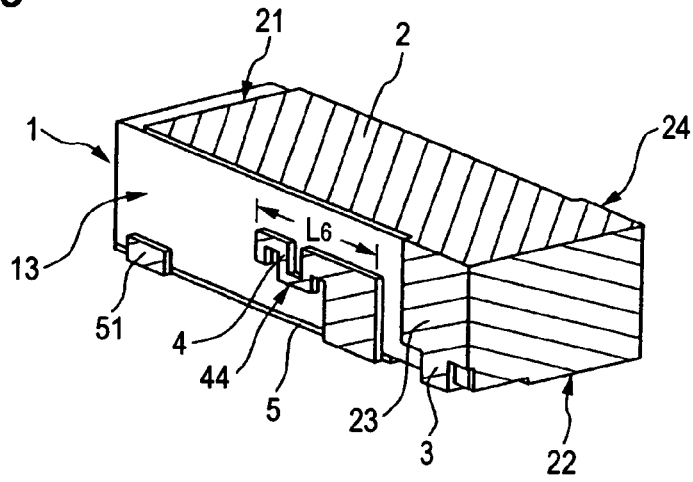
FIG. 8 is a perspective view of a dielectric antenna according to a fifth embodiment of the invention.
Figure 9:
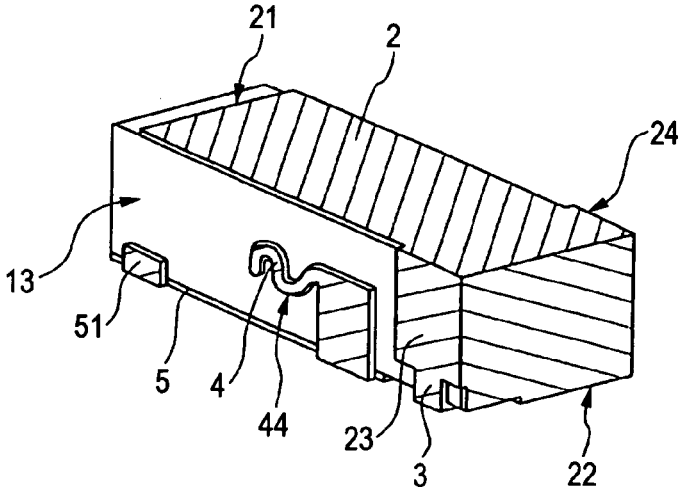
FIG. 9 is a perspective view of a dielectric antenna according to a sixth embodiment of the invention.

FIGS. 8 and 9 show fifth and sixth embodiments of the invention. Similar components to those in the first embodiment will be designated by the same reference number and the repetitive explanation for those will be omitted.

In these embodiments, the second radiation electrode 4 is extended in a meandering manner (cranked or curved). With this configuration, it is possible to shorten the physical length $L_6$ in the longitudinal direction to obtain the required electrical length (¼ of the wavelength of the resonance frequency). Consequently, the meandering form is readily provided on the second side face 13 in case that it is necessary to increase the length of the second radiation electrode 4 when the second frequency band is relatively low.

Further, since the whole length $L_6$ in the longitudinal direction of the second radiation electrode 4 is made shorter by forming the second radiation electrode 4 in the meandering manner, the length of the portion of the second radiation electrode 4 opposing to the first radiation electrode 2 on the top face 11 can be shortened, so that the capacity is made smaller and also the degree of coupling between both the radiation electrodes is lowered. Therefore, the same effect as what makes the distance B between the radiation electrodes 2 and 4 shown in FIG. 1A greater. Moreover, since the space between both the radiation electrodes is caused to become smaller and greater periodically, the capacity of a receding portion 44 is decreased further, so that the degree of coupling between the radiation electrodes as a whole can be lowered. In this case, the first radiation electrode 2 or both the radiation electrodes may be formed in the meandering manner. This structure is applicable to each of the aforementioned embodiments.

Figure 10A:
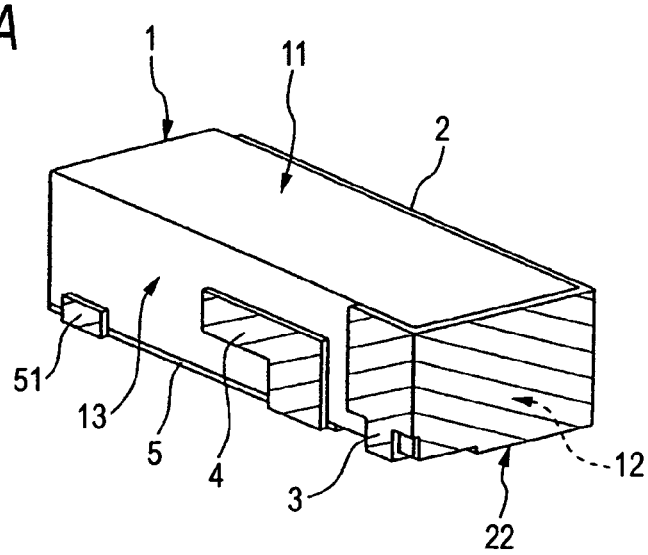
FIG. 10A is a perspective top view of a dielectric antenna according to a seventh embodiment of the invention.
Figure 10B:
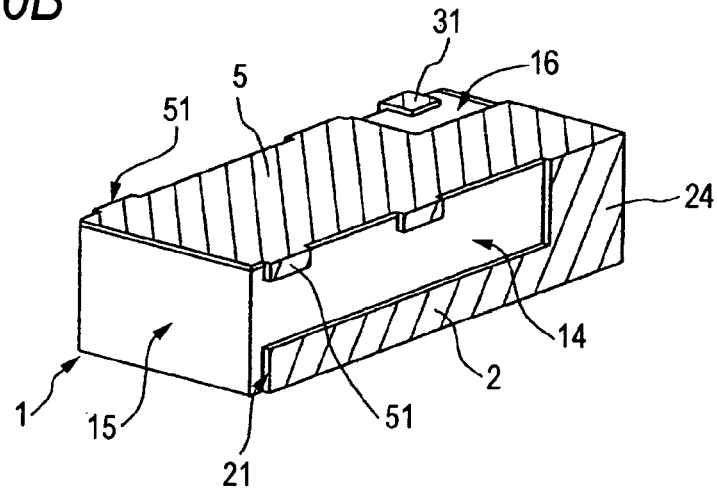
FIG. 10B is a perspective bottom view of the dielectric antenna of FIG. 10A.

FIG. 10 shows a seventh embodiment of the invention. Similar components to those in the first embodiment will be designated by the same reference number and the repetitive explanation for those will be omitted.

In this embodiment, no radiation electrode is provided on the top face 11. Instead, the first radiation electrode 2 is provided so as to extend from the third side face 14 to the second side face 13 via the first side face 11 and is connected to the feeder electrode 3 formed on the second side face 13. A part of the first radiation electrode 2 formed on the first side face 12 is connected to the grounding electrode 5. Consequently, the feeder electrode 3 is formed in a position where the impedance becomes a predetermined value apart by a predetermined distance from the portion where the radiation electrode 2 is connected to the grounding electrode 5, whereby an inverted-F antenna can be formed as in each of the aforementioned embodiments. The length of the whole portion of the first radiation electrode 2 extended linearly is needless to say adjusted so that the resonance is triggered in the first frequency band $f_1$.

With the arrangement above, the feeder electrode 3 is electromagnetically coupled with the first radiation electrode 2 and the second radiation electrode 4 and one antenna is allowed to deal with dual band. In this case, since the first radiation electrode 2 and the second radiation electrode 4 are provided on the opposite side faces of the dielectric substrate 1, the distance therebetween can be enlarged, whereas both of them are coupled less intimately, whereby the resonance frequency and matching characteristic of each can be adjusted independently. Moreover, since the top face 11 is set free from being used for printing the conductive film so as to form an electrode, one manufacturing step can be omitted.

In the above embodiments, the first radiation electrode 2 is formed over the whole width of the top face 11 of the dielectric substrate 1. However, the width of the radiation electrode 2 may be smaller than the width of the whole width of the top face 11. In such a case, the space between the first radiation electrode 2 and the second radiation electrode 4 is enlarged and this is preferable in that both the radiation electrodes are weakly coupled together.

In the above embodiments, the second radiation electrode 4 is provided near the feeder electrode 3 so that the second radiation electrode 2 is directly coupled with the feeder electrode 3. However, the second radiation electrode 4 may be formed on the third side face. 14 opposing the second side face 13. In this case, though the second radiation electrode 4 is not directly coupled with the feeder electrode 3 because the former is separated from the latter, the second radiation electrode 4 and the first radiation electrode 2 are disposed close to each other whereby to couple the second radiation electrode 4 with the feeder electrode 3 via the first radiation electrode 2. As the first radiation electrode 2 renders a contribution to the second frequency band, there arises a complicated problem from the relevancy of the resonance frequency and VSWR to the first radiation electrode. However, it is possible to mass-produce similar antennas because of the reproducibility of the same structure when an adjustment is made once though.

Figure 11:
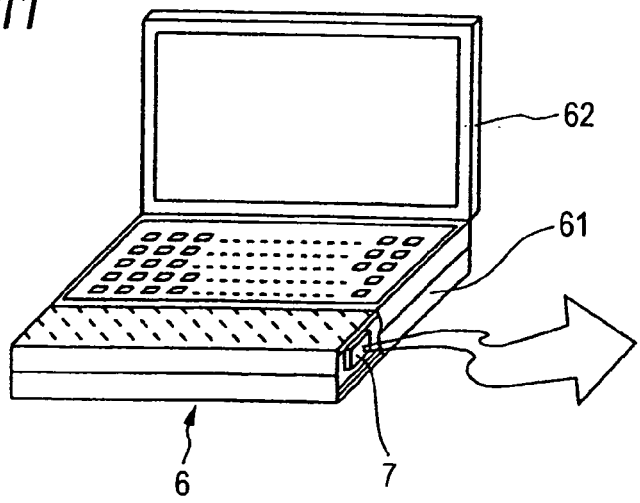
FIG. 11 is a perspective view of a personal computer incorporating the dielectric antenna of the invention.
Figure 12:
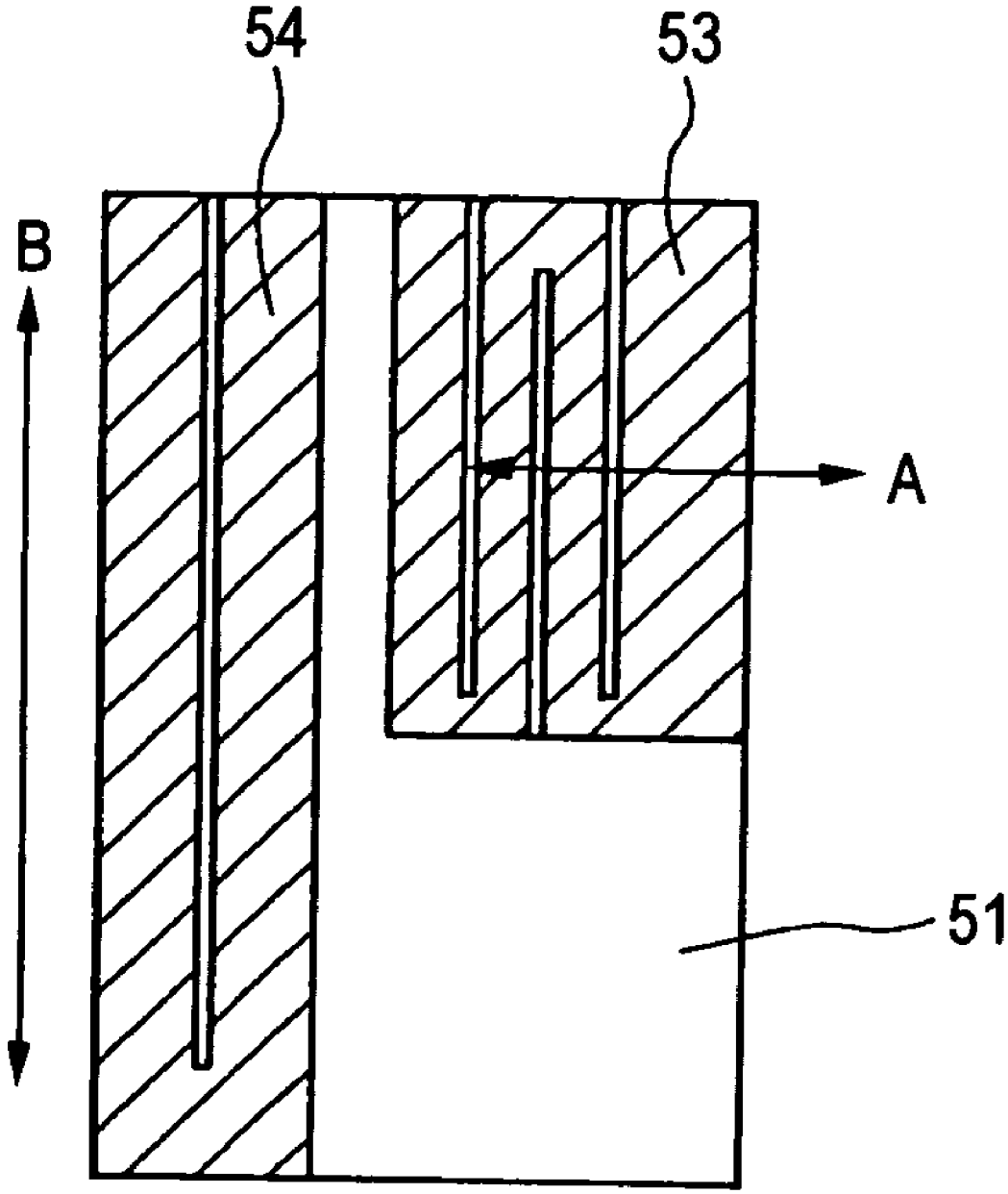
FIG. 12 is a plan view of a related-art dielectric antenna.

FIG. 11 shows an example of a personal computer loaded with an antenna for use in forming LAN. An antenna 7 is mounted inside the side wall 61 of a personal computer 6 and connected to a communication circuit (not shown) provided inside the personal computer 6, so that radio communication is carried out with any other personal computer, cellular phone or the like having the same communication functions. In this case, it is preferable that the antenna 7 is disposed such that the second radiation electrode 4 faces upward. Further, the place of mounting the antenna 7 is not limited to a position indicated in FIG. 11 but may be on the other side, the back side of the personal computer 6 or in a cover portion 62. In the case of a cellular phone, the grounding electrode of the antenna 7 may be mounted by soldering in the upper corner of a built-in circuit board of the cellular phone with the fixing terminal 51 above.

While information is being processed by the personal computer, the information can be communicated between units of electrical equipment. Moreover, as the second frequency band with high frequencies is usable for the communication of images having a large quantity of information, the radio communication of a large quantity of information can be made in an extremely short time.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A dielectric antenna, comprising:

a dielectric substrate, having a first face, a second face opposing to the first face, and side faces connecting the first face and the second face;

a grounding electrode provided on the first face;

a first radiation electrode, configured to resonate with an electromagnetic wave having a first frequency in a first frequency band, the first radiation electrode being extended parallel to at least one of the second face and the side faces so as to serve as an inverted-F antenna;

a feeder electrode, extended parallel to one of the side faces, and electrically connected with the first radiation electrode; and a second radiation electrode, configured to resonate with an electromagnetic wave having a second frequency in a second frequency band, wherein the second frequency band is distinct from the first frequency band, the second radiation electrode being extended parallel to one of the side faces and separated from the first radiation electrode and the feeder electrode so as to be electromagnetically coupled with at least one of the first radiation electrode and the feeder electrode, wherein one end of the feeder electrode serves as a terminal for supplying power to the first radiation electrode and the second radiation electrode.

2. The dielectric antenna as set forth in claim 1, wherein:

the first radiation electrode extends parallel to at least one of the second face and a first one of the side faces;

the first radiation electrode has a first end which is made open and a second end which is connected to the ground electrode;

the feeder electrode extends parallel to one of the first one of the side faces and a second one of the side faces; and the second radiation electrode extends parallel to one of the second one of the side faces.

3. The dielectric antenna as set forth in claim 2, wherein:

the second radiation electrode has a first end which is made open and a second end which is connected to the ground electrode; and the second radiation electrode extends so as to have at least one curved portion.

4. The dielectric antenna as set forth in claim 2, wherein the first radiation electrode includes a first section extending parallel to the second face, and a second section extending parallel to at least one of the side faces so as to connect the first section and the grounding electrode.

5. The dielectric antenna as set forth in claim 3, wherein the second radiation electrode extends in a meandering manner.

6. The dielectric antenna as set forth in claim 1, wherein the first radiation electrode is provided on a first one of the side faces, and the second radiation electrode is provided on a second one of the side faces which opposes to the first one of the side faces.

7. The dielectric antenna as set forth in claim 1, wherein the first radiation electrode and the feeder electrode are directly connected.

8. The dielectric antenna as set forth in claim 1, wherein the terminal is provided on the first face while being insulated from the grounding electrode.

9. A communication device, comprising:

a communication circuit, adapted to execute data communication with an external communication device; and the dielectric antenna as set forth in claim 1, electrically connected to the communication circuit.

* * * * *